US012497858B2

(12) United States Patent
Crews et al.

(10) Patent No.: US 12,497,858 B2
(45) Date of Patent: Dec. 16, 2025

(54) HYDRAULIC FRACTURING PLUG

(71) Applicant: Longbow Completion Services, LLC, Midland, TX (US)

(72) Inventors: Christopher Crews, Splendora, TX (US); Joseph Mize, Midland, TX (US); Shawn Witt, Kirkland, WA (US)

(73) Assignee: Longbow Completion Services, LLC, Midland, TX (US)

( * ) Notice: Subject to any disclaimer, the term of this patent is extended or adjusted under 35 U.S.C. 154(b) by 0 days.

(21) Appl. No.: 18/415,645

(22) Filed: Jan. 18, 2024

(65) Prior Publication Data

US 2024/0151117 A1 May 9, 2024

Related U.S. Application Data

(63) Continuation of application No. 17/203,072, filed on Mar. 16, 2021, now Pat. No. 11,891,877.

(60) Provisional application No. 62/990,082, filed on Mar. 16, 2020.

(51) Int. Cl.

| | |
|---|---|
| ***E21B 34/06*** | (2006.01) |
| ***E21B 33/129*** | (2006.01) |
| *E21B 43/26* | (2006.01) |

(52) U.S. Cl.

CPC ..... *E21B 34/063* (2013.01); *E21B 33/1293* (2013.01); *E21B 43/26* (2013.01)

(58) Field of Classification Search

CPC ..... E21B 34/063; E21B 33/1293; E21B 43/26
See application file for complete search history.

(56) References Cited

U.S. PATENT DOCUMENTS

| | | | | |
|---|---|---|---|---|
| 3,602,934 | A * | 9/1971 | Reed | B08B 9/0553 15/104.061 |
| 6,167,963 | B1 * | 1/2001 | McMahan | E21B 33/1216 166/134 |
| 6,213,204 | B1 * | 4/2001 | Doane | E21B 23/01 166/134 |
| 6,244,642 | B1 | 6/2001 | Serafin et al. | |
| 6,491,116 | B2 | 12/2002 | Berscheidt et al. | |
| 7,475,736 | B2 | 1/2009 | Lehr et al. | |
| 7,810,558 | B2 | 10/2010 | Shkurti et al. | |
| 8,047,280 | B2 | 11/2011 | Tran et al. | |
| 8,469,088 | B2 | 6/2013 | Shkurti et al. | |
| 9,045,963 | B2 | 6/2015 | Shkurti et al. | |
| 9,157,288 | B2 | 10/2015 | Martinez | |
| 9,404,330 | B2 | 8/2016 | Speer et al. | |

(Continued)

*Primary Examiner* — D. Andrews
(74) *Attorney, Agent, or Firm* — Norton Rose Fulbright US LLP

(57) ABSTRACT

A plug and perforation system includes a plug that is configured to isolate formation zones within a wellbore that has a casing. The plug includes a flow control subassembly, an anchoring subassembly, and a sealing device. The flow control subassembly a valve assembly. The valve assembly includes a housing, a valve chamber inside the housing, a valve seat, and a valve element inside the valve chamber. In some embodiments, the valve element is secured to the housing with a frangible matrix that is manufactured as a unitary part with the valve element and the housing. The frangible matrix is designed to fail under a predetermined shearing load to allow the valve element to be pushed into the valve seat. In other embodiments, the valve element is retained by one or more shear pins or shearable threads.

20 Claims, 7 Drawing Sheets

(56) References Cited

U.S. PATENT DOCUMENTS

| | | | | |
|---|---|---|---|---|
| 10,024,125 | B2 | 7/2018 | Webster et al. | |
| 10,024,134 | B2 | 7/2018 | Webster et al. | |
| 10,100,601 | B2 * | 10/2018 | King | E21B 33/134 |
| 10,378,303 | B2 * | 8/2019 | Hayter | G05B 19/4099 |
| 10,435,982 | B2 | 10/2019 | Shkurti et al. | |
| 2003/0111236 | A1 | 6/2003 | Serafin et al. | |
| 2004/0065442 | A1 * | 4/2004 | Myerley | E21B 34/102 166/373 |
| 2008/0199339 | A1 * | 8/2008 | Near | F04C 14/04 418/48 |
| 2012/0125637 | A1 | 5/2012 | Chenault et al. | |
| 2012/0181032 | A1 | 7/2012 | Naedler et al. | |
| 2012/0255723 | A1 | 10/2012 | Standridge | |
| 2014/0027127 | A1 | 1/2014 | Frazier et al. | |
| 2014/0190685 | A1 | 7/2014 | Frazier et al. | |
| 2015/0275605 | A1 | 10/2015 | Bennett et al. | |
| 2016/0032684 | A1 | 2/2016 | Shkurti et al. | |
| 2017/0101845 | A1 * | 4/2017 | Kellner | E21B 33/134 |
| 2018/0106120 | A1 | 4/2018 | Harris et al. | |
| 2018/0187509 | A1 | 7/2018 | Zhong et al. | |
| 2020/0115988 | A1 | 4/2020 | Wilcox et al. | |
| 2020/0157900 | A1 | 5/2020 | Hern et al. | |
| 2020/0157913 | A1 * | 5/2020 | Hern | E21B 33/1285 |
| 2020/0347694 | A1 | 11/2020 | Power et al. | |
| 2021/0317724 | A1 | 10/2021 | Romer et al. | |

* cited by examiner

HYDRAULIC FRACTURING PLUG

CROSS-REFERENCE TO RELATED APPLICATIONS

This application is a continuation of U.S. patent application Ser. No. 17/203,072, filed Mar. 16, 2021, which claims the benefit of U.S. Provisional Patent Application Ser. No. 62/990,082 filed Mar. 16, 2020 entitled "Hydraulic Fracturing Plug," the disclosure of each of which are herein incorporated by reference.

FIELD OF INVENTION

This invention relates generally to the field of hydraulic fracturing systems, and more particularly, but not by way of limitation, to a plug for controlling access to selective zones within a well during a hydraulic fracturing operation.

BACKGROUND

Hydrocarbons, such as oil and gas, may be recovered from various types of subsurface geological formations. The oil and gas is accessed through a well which is typically drilled from the surface to the producing formation. In many wells, hydraulic fracturing is used to promote the production of oil and gas from the formation. A process known as plug and perforation is used to isolate and independently stimulate specific zones within the well.

When the well has been drilled to the desired depth, a steel casing is typically installed and cemented within the wellbore to prevent the sides of the wellbore from collapsing and to control the flow of fluids from the formation into the wellbore. Once the casing is cemented in place, a section of the well bore can be perforated to provide a path from the formation to the wellbore through the cement and casing. In most cases, explosive charges or high pressure fluids are used to perforate the casing and cement. Once the casing has been perforated, the adjacent and nearby formation can be stimulated through hydraulic fracturing, which injects high pressure fluid and proppant into the formation to open and suspend small cracks in the formation.

In wells that are drilled through multiple production zones, it may be desirable to sequentially stimulate the zones by conducting multiple hydraulic fracturing operations. Plugs or other zone isolation devices are used to control which zones are stimulated by blocking the flow of pressurized fracturing fluid to lower portions of the wellbore. Multiple plugs can be deployed and retrieved to carry out a strategic sequence of hydraulic fracturing.

Several types of plugs have been used in the past. In some cases, the plug is a simple blocking device that must be removed or destroyed with a drill to permit flow of wellbore fluids through the plug. In other cases, the plug is provided with a controllable valve mechanism that can be closed to prevent flow through the plug during a stimulation exercise and opened to permit flow during the production phase of the hydrocarbon recovery effort. A "ball drop plug" utilizes a ball which is dropped into the wellbore and caught by the plug to switch the plug from an open state to a closed state in which flow from the surface is prohibited from passing through the plug. Although widely adopted, conventional ball drop plugs tend to be slow to install and operate and it can be difficult to confirm that the dropped ball has placed the appropriate plug in a closed position.

In contrast to a ball drop plug, a ball-in-place plug is set into the wellbore with a ball already on the seat of the plug while it is run in hole. This speeds the frac process up so that the operator does not have to pump a ball to seat. Although these plugs are generally effective at isolating lower zones from pressurized fluid above the plug during a hydraulic fracturing operation, the existing ball-in-place plugs do not permit flow through the plug from the surface for pump down or other operations. If, for example, there are issues with the perforation process, the inability to flow fluid from the surface through the ball-in-place plug can cause costly delays. In these instances it can be necessary to drill out and replace the entire ball-in-place plug.

There is, therefore, a need for an improved plug which saves production time by allowing fluid to flow through the plug and which does not require a ball drop step to set the plug. It is to these and other objectives that the present invention is directed.

SUMMARY

In one embodiment, the present disclosure is directed to a plug configured to isolate formation zones within a wellbore that has a casing. The plug includes a flow control subassembly configured to control the flow of fluid through the plug, an anchoring subassembly configured to secure the plug in the casing of the well bore, and a sealing device configured to prevent flow around the plug within the casing of the wellbore. The flow control subassembly has a mandrel that includes a central flow passage, and a valve assembly. The valve assembly includes a housing, a valve chamber inside the housing, a valve seat between the valve chamber and the central flow passage of the mandrel, and a valve element inside the valve chamber. The valve element is secured to the housing with a frangible matrix when the valve element is in a first position and spaced apart from the valve seat.

In another embodiment, the present disclosure is directed to a plug configured to isolate formation zones within a wellbore that has a casing. The plug includes a flow control subassembly configured to control the flow of fluid through the plug, an anchoring subassembly configured to secure the plug in the casing of the well bore, and a sealing device configured to prevent flow around the plug within the casing of the wellbore. The flow control subassembly has a mandrel that includes a central flow passage, and a valve assembly. The valve assembly includes a housing, a valve chamber inside the housing, a valve seat between the valve chamber and the central flow passage of the mandrel, and a valve element inside the valve chamber. The valve element is secured to the housing with one or more shear pins when the valve element is in a first position and spaced apart from the valve seat.

In yet another embodiment, the present disclosure is directed to a plug configured to isolate formation zones within a wellbore that has a casing. The plug includes a flow control subassembly configured to control the flow of fluid through the plug, an anchoring subassembly configured to secure the plug in the casing of the well bore, and a sealing device configured to prevent flow around the plug within the casing of the wellbore. The flow control subassembly has a mandrel that includes a central flow passage, and a valve assembly. The valve assembly includes a housing, a valve chamber inside the housing, a valve seat between the valve chamber and the central flow passage of the mandrel, and a valve element inside the valve chamber. The valve element is secured to the housing with a frangible matrix when the valve element is in a first position and spaced apart from the valve seat. In this embodiment, the anchoring subassembly includes upper slips and lower slips, and the sealing device is located between the upper slips and the lower slips.

DETAILED DESCRIPTION OF ILLUSTRATIVE EMBODIMENTS

Figure 1:
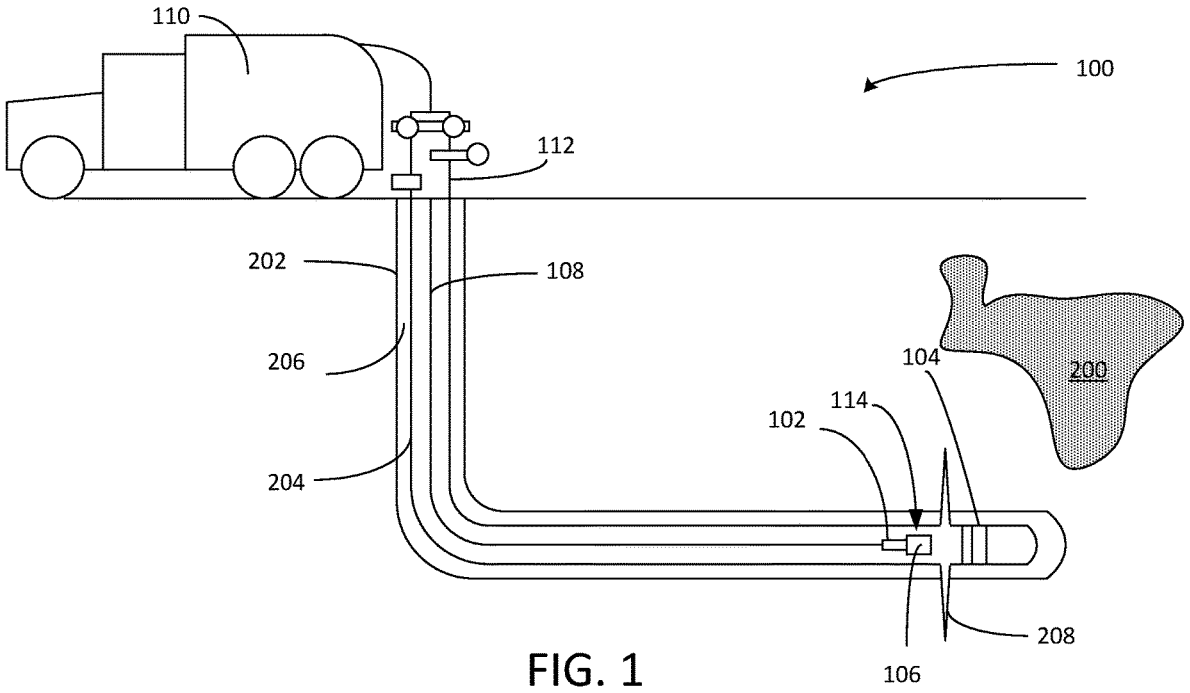
FIG. 1 depicts a cross-sectional view of a formation with a horizontal wellbore and one perforated zone.

In accordance with exemplary embodiments of the present invention, FIG. I depicts a plug and perforation system I00 installed within a well bore 202, which is drilled for the production of a fluid such as water or petroleum from a geological formation 200. As used herein, the term "petroleum" refers broadly to all mineral hydrocarbons, such as crude oil, gas and combinations of oil and gas. The well bore 202 is lined with a casing 204 which is set with cement 206. The casing 204 and cement 206 prevent the wellbore 202 from collapsing. After the casing 204 and cement 206 are set into the well bore 202, the plug and perforation system 100 can be used to prepare the wellbore 202 for hydraulic fracturing.

The plug and perforation system 100 prepares the formation 200 for hydraulic fracturing by perforating the casing 204 and cement 206 using a perforation gun 102 and isolating sections of the wellbore 202 using plugs 104. Using the plug and perforation system 100, sections of the well bore 202 can be independently perforated. Each perforated section can then be isolated from other sections using one or more plugs 104 so that each perforated section can then be independently hydraulically fractured.

The plug and perforation system 100 includes a setting tool 106 that is connected to the plug 104, a perforation gun 102, and a wireline 108. The plug 104, perforation gun 102 and setting tool 106 can be referred to as the downhole plug assembly 114. The downhole plug assembly 114 is deployed and retrieved using wireline 108. The wireline 108 runs from a wireline van 110 or other wireline deployment machine into the well bore 202 through a wellhead 112. In some applications, it may be desirable to pump fluid through the wellhead 112 into the wellbore 102 to facilitate the deployment of the downhole plug assembly 114 into the well bore 102.

As seen in FIG. 1 the perforation gun 102, plug 104, and setting tool 106 have been lowered into a horizontal portion of the well bore 202 and the perforation gun 102 has been used to create perforations 208 in the formation 200 through the casing 204 and cement 206. The perforation gun 102, and setting tool 106 can now be retrieved and the perforations 208 can be hydraulically fractured ("fracked") to create fissures 210 in the formation 200.

Figure 2:
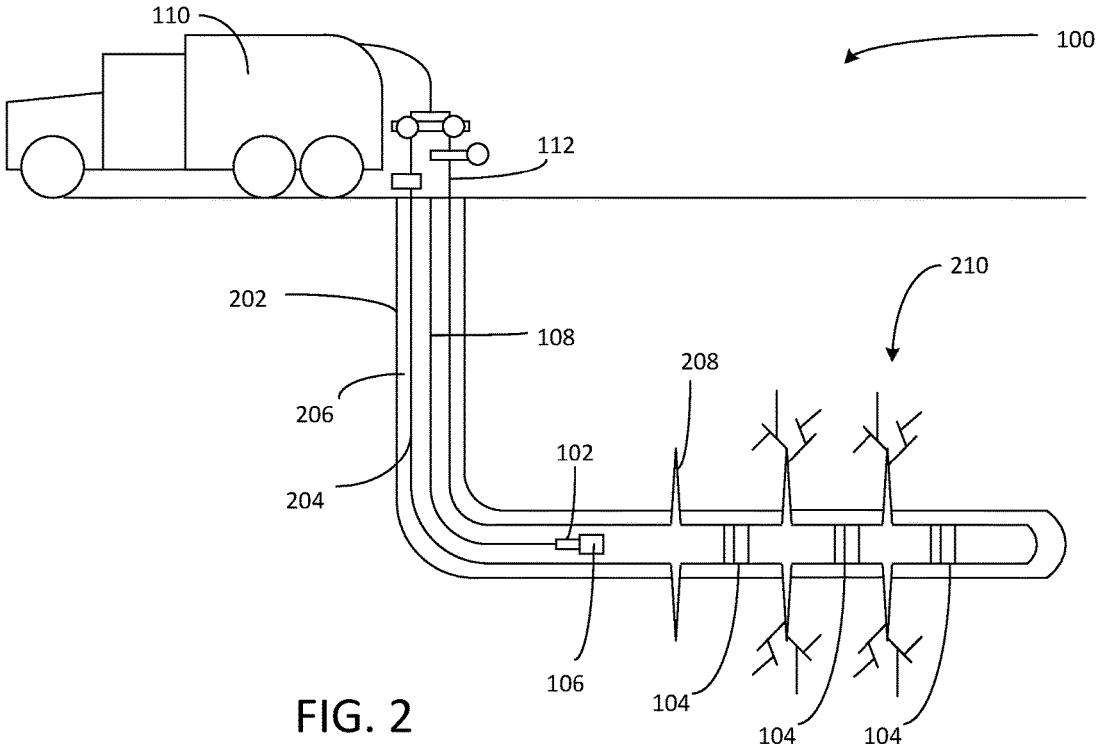
FIG. 2 depicts a cross-sectional view of a formation with a horizontal wellbore with one perforated zone, two fractured zones, and three set plugs.

After the perforated section of the formation 200 has been fracked, the perforation gun 102, plug 104, and setting tool 106 are again lowered into the wellbore 202 using the wireline 108, but this time at a new depth above the fractured section of the well bore 202. The plug 104 is then set into the casing 204 using the setting tool 106 in a position uphole from the earlier perforations 208. The perforation gun 102 can then be used again to perforate a new section of formation 200 uphole from the plug 104, to prepare the proximate section of the wellbore 202 for stimulation. This process of perforating, plugging, and fracking can be repeated until the formation 200 is sufficient fracked and ready for production, as depicted in FIG. 2.

Figure 3:
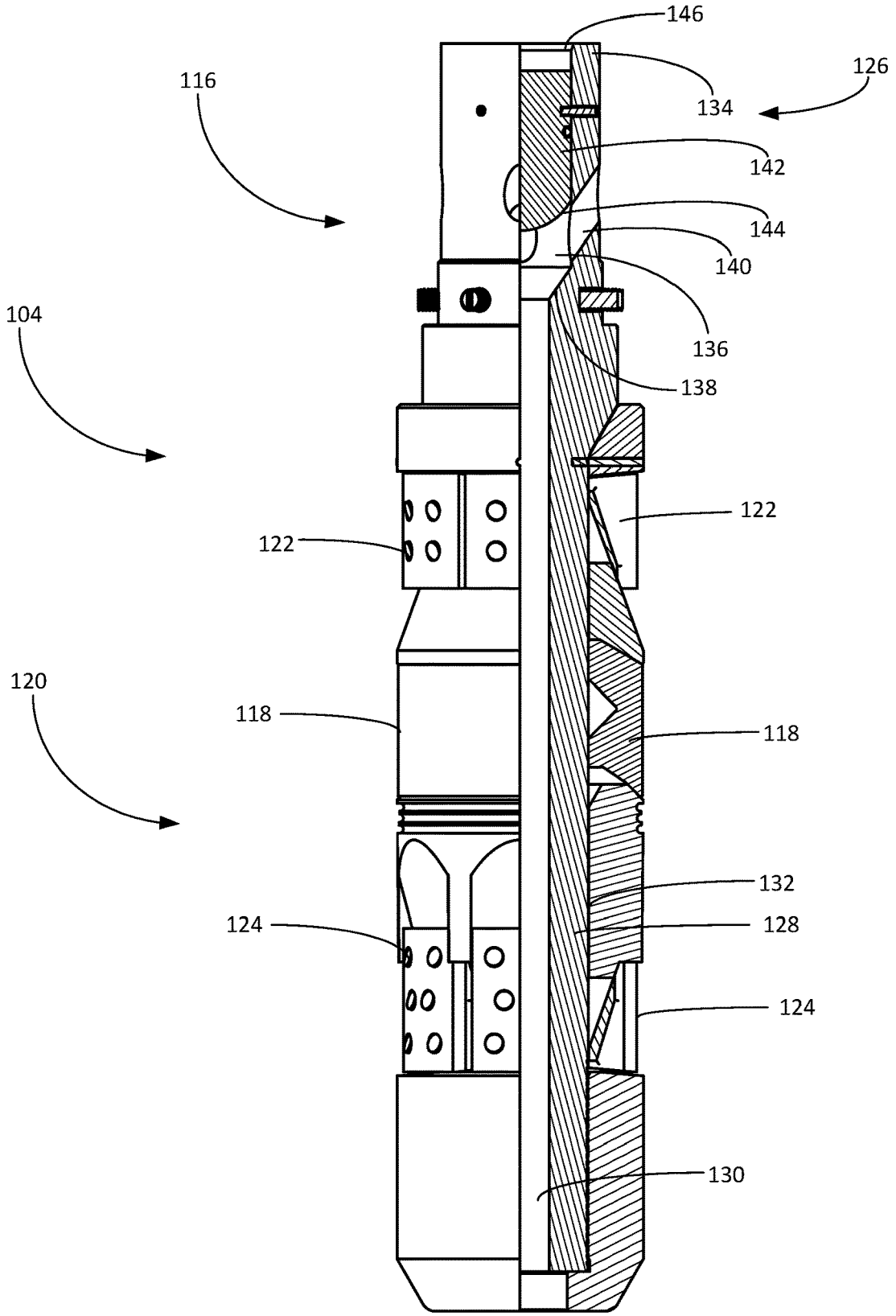
FIG. 3 is a partial cross-sectional view of a plug constructed in accordance with one embodiment of the flow control subassembly.

Turning now to FIG. 3, shown therein is a partial cross-sectional view of the plug 104 constructed in accordance with a first embodiment. The plug 104 includes a flow control subassembly 116, a sealing device 118 and an anchoring subassembly 120. The anchoring subassembly 120 sets the plug 104 into the casing 204 of the wellbore 202, preventing movement of the plug 104 within the casing 204. The anchoring subassembly 120 includes upper slips 122 and lower slips 124 which can be radially deployed against the casing 204 in response to a compressive force applied by the setting tool 106 across the length of the plug 104. The sealing device 118 seals the setting between the anchoring subassembly 120 and the casing 204, thereby preventing fluid from flowing between the plug 104 and the casing 204. In the present embodiments the sealing device 118 is positioned between the upper slips 122 and lower slips 124.

Figures 4A, 4B:
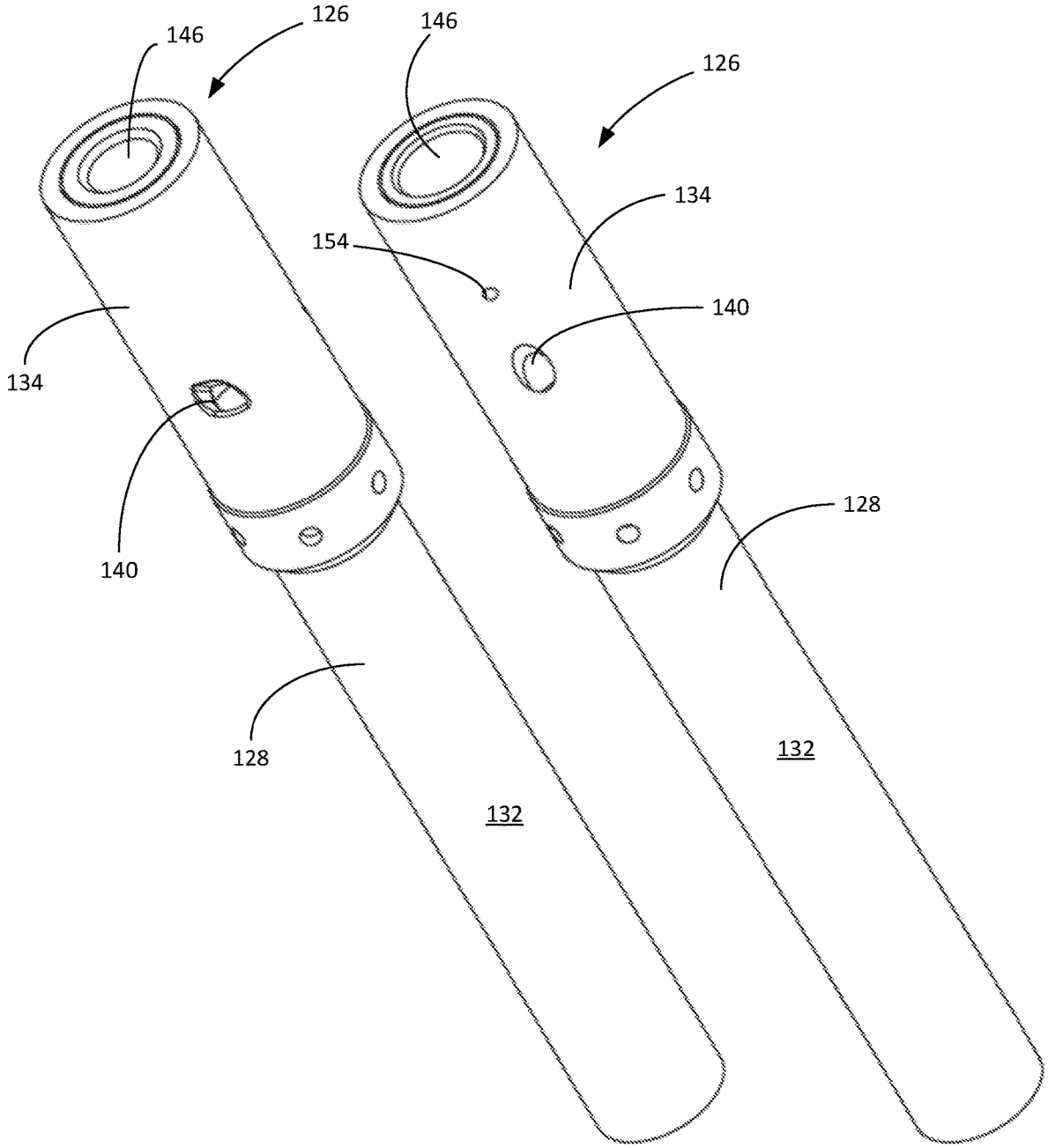
FIGS. 4A and 4B are perspective views of the first and second embodiments of the flow control subassembly of the plug.
Figure 5A:
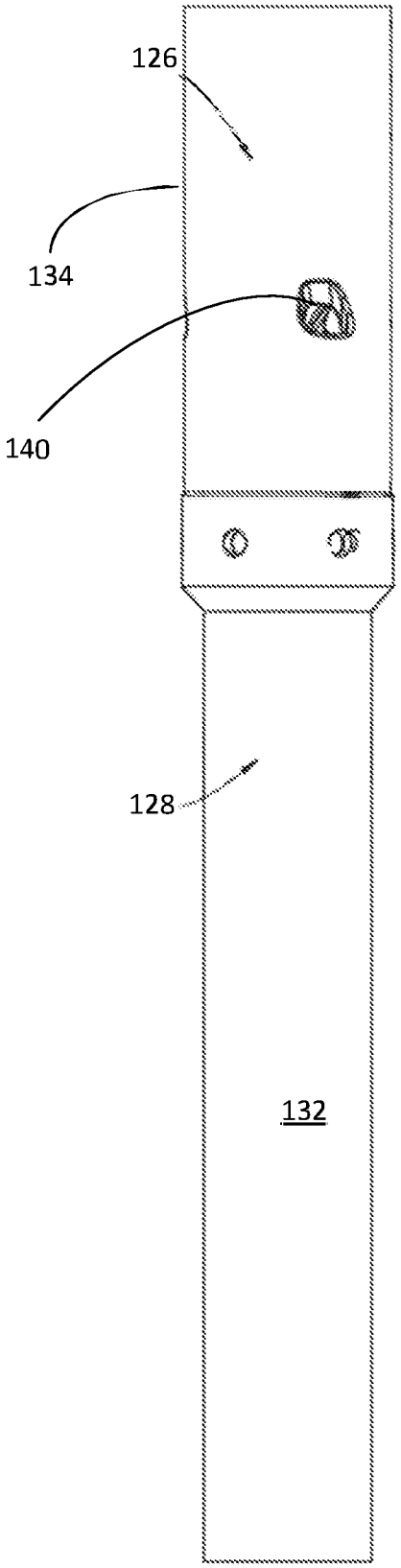
FIGS. 5A and 5B are top views of the first and second embodiments of the flow control subassembly of the plug.
Figure 5B:
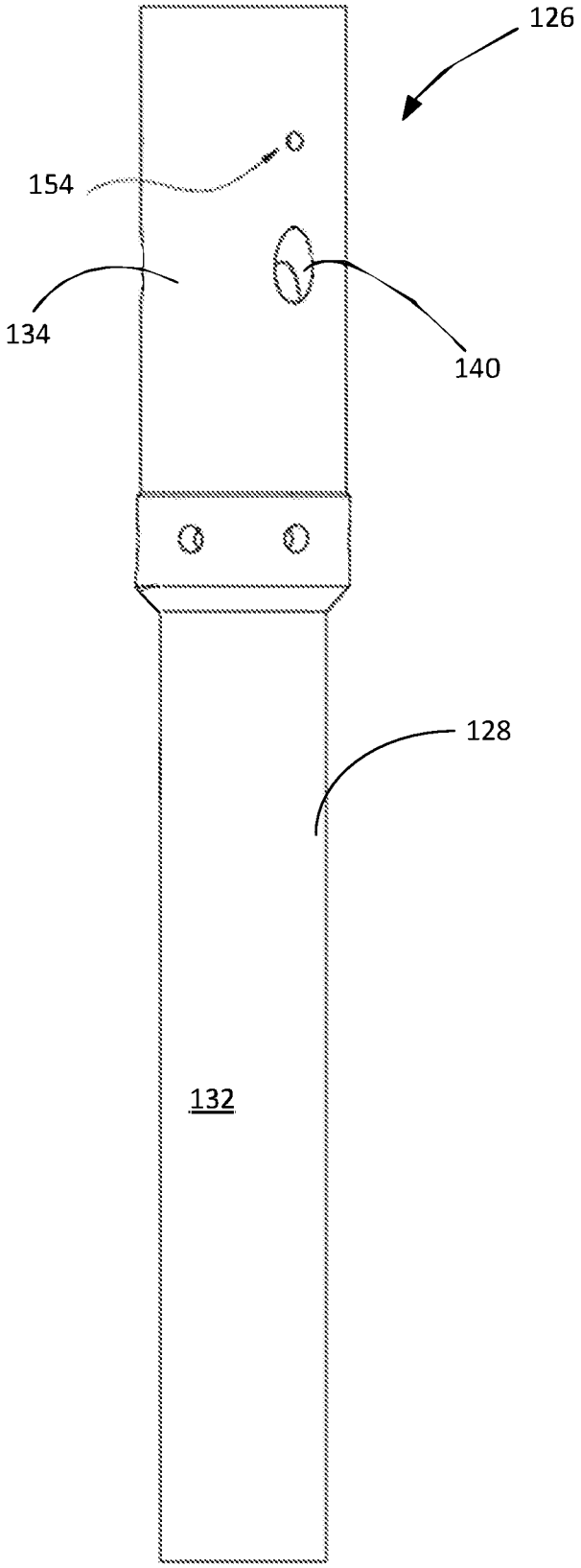
Figure 6A:
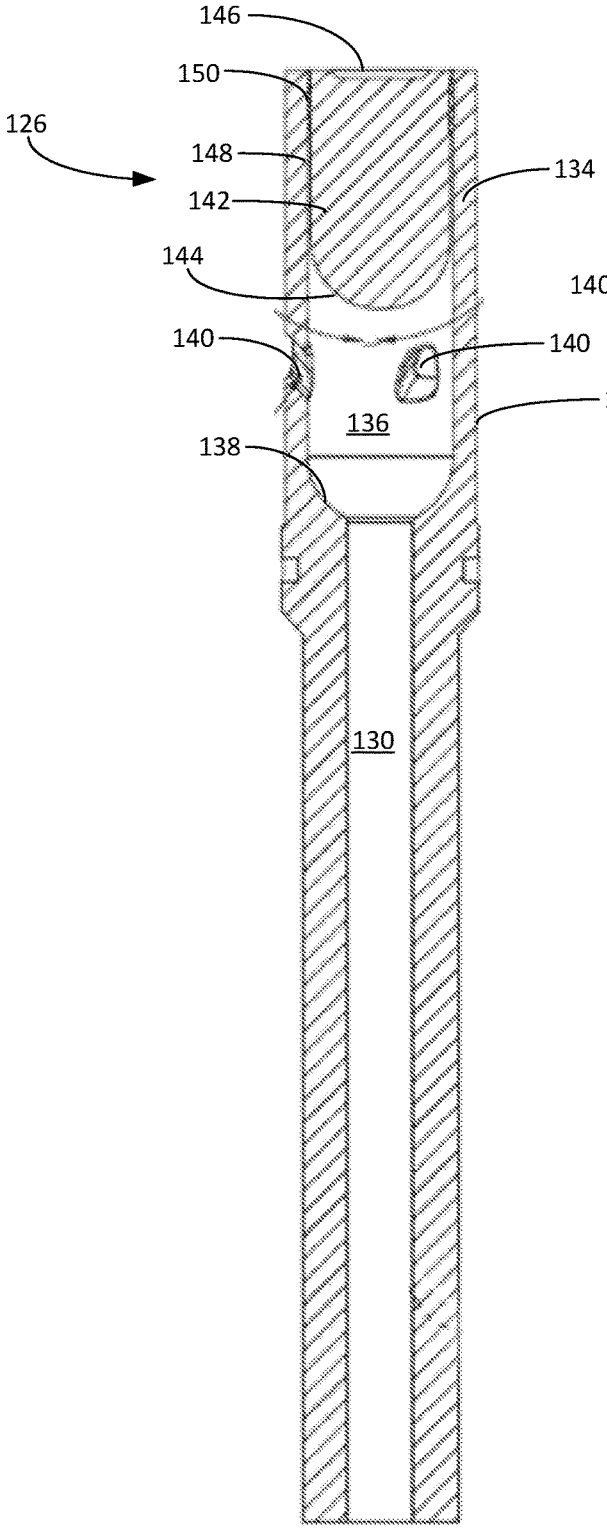
FIGS. 6A and 6B are cross-sectional views of the first and second embodiments of the flow control subassembly of the plug.
Figure 6B:
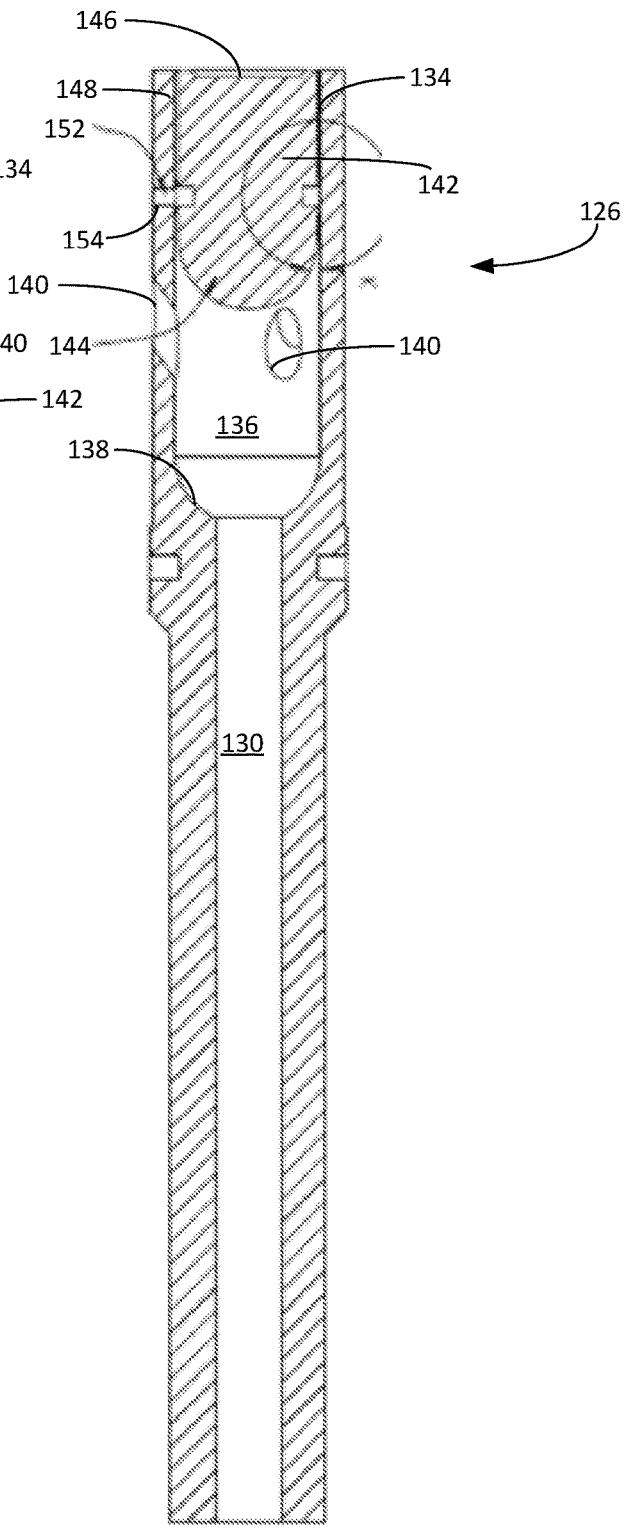

The flow control subassembly 116 controls the flow of fluid through the plug 104. An isolated view of a first embodiment of the flow control subassembly 116 is depicted in FIGS. 4A, 5A and 6A. An isolated view of a second embodiment of the flow control subassembly 116 is depicted in FIGS. 4B, 5B and 6B. In both embodiments, the flow control subassembly 116 includes a valve assembly 126 and a mandrel 128. The mandrel 128 includes a central flow passage 130. The sealing device 118 and the anchoring subassembly 120 are supported by, and concentric with, the exterior surface 132 of the mandrel 128.

In both embodiments, the valve assembly 126 includes a housing 134, a valve chamber 136 in the interior of the housing 134, a valve seat 138, one or more bypass ports 140 and a valve element 142. The valve seat 136 is located between the valve chamber 134 and the central flow passage 130. The bypass ports 140 extend through the housing 134 to permit flow from the wellbore 202 into the valve chamber 136. Importantly, the bypass ports 140 are configured to accelerate the fluid as it passes through the valve chamber 136, thereby creating a strong vacuum under the valve element 142.

The valve element 142 approximates a half capsule shape with a rounded sealing surface 144 that conforms closes with the contour of the valve seat 138, and a flat outer face 146 that is exposed to the exterior of the plug 104. The valve element 142 has an outer diameter that is only slightly smaller than the interior diameter of the valve chamber 136. In this way, very little fluid is permitted to pass through an annular space 148 between the valve element 142 and the housing 134. In other embodiments, the valve element 142 is ball-shaped, conical or box-shaped, in each case paired with a valve seat 138 with a matching profile.

Figure 7:
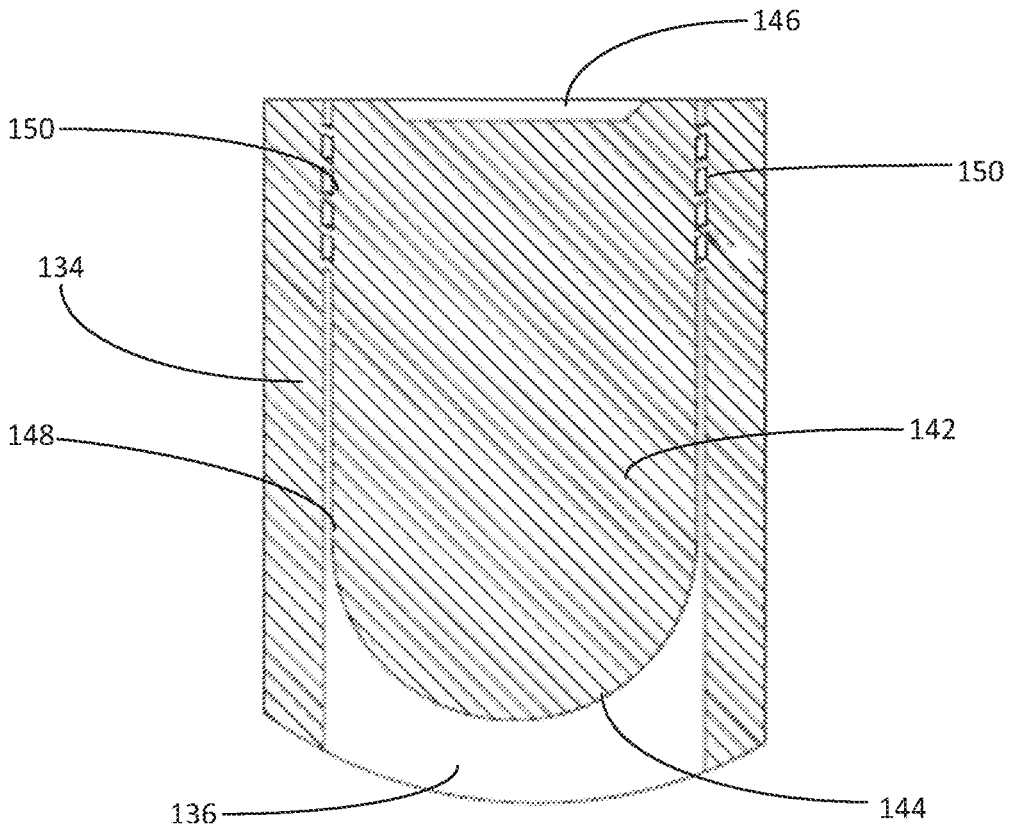
FIG. 7 is a close-up cross-sectional view of the valve element and frangible matrix of the first embodiment of the flow control subassembly.
Figure 8:
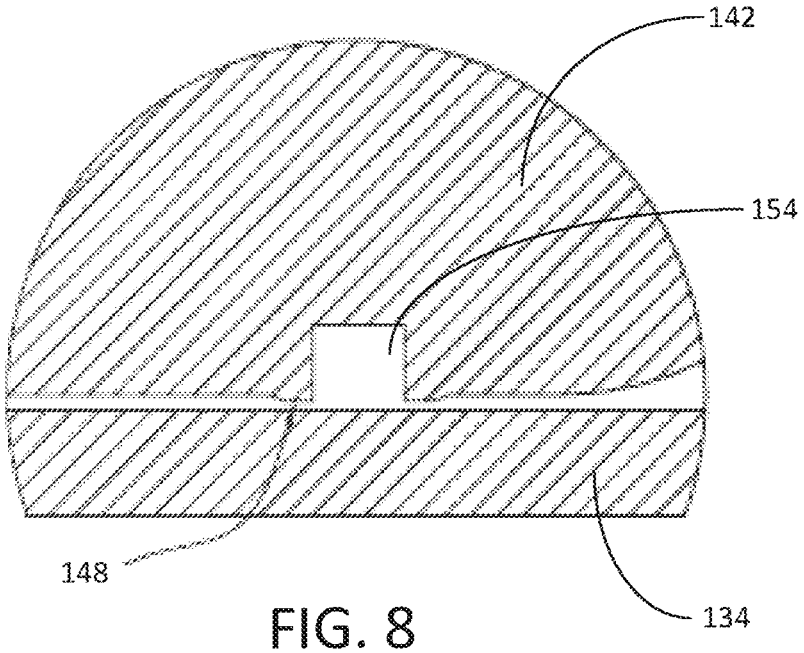
FIG. 8 is a close-up cross-sectional view of the shear pin notch and annular space of the second embodiment of the flow control subassembly.

In the first embodiment depicted in FIGS. 4A, 5A and 6A, the valve element 142 is held in an initial unseated position by a frangible matrix 150 connecting the valve element 142 to the housing 134. As best depicted in the cross-sectional view of FIG. 7, the frangible matrix 150 can comprise a series of small tabs extending across the annular space 148 between the valve element 142 and the housing 134. In some embodiments, the frangible matrix 150 is manufactured as an integral part of a unitary housing 134 and valve seat 138. Additive manufacturing using suitable composite or polymer materials can be used to produce the valve assembly 126 as a single unitary piece in which the valve element 142 is joined to the housing 134 through the frangible matrix 150 during manufacturing.

In this first state, the valve element 142 is retained in a position above the bypass ports 140, such that fluids may pass through the valve chamber 136. The frangible matrix 150 is designed to fail in response to the application of a force differential across the valve element 142 that exceeds a predetermined maximum shear load on the frangible matrix 150. The force differential is created by a combination of fluid pressure acting on the top of the valve element 142 and a suction force under the valve element 142 caused by the acceleration of fluid through the bypass ports 140. In some embodiments, the negative pressure acting under the valve element 142 is primarily responsible for causing the frangible matrix 150 to fail. When the frangible matrix 150 fails, the valve element 142 is pulled down onto the valve seat 138. When the valve element 142 is moved into this second state against the valve seat 138, the valve element 142 also blocks the bypass ports 140. In this way, the valve element 142 prevents fluid from flowing through the valve assembly 126 into the central flow passage 130.

If the valve element 142 is later pushed off the valve seat 138 by upward flow through the central flow passage 130, the valve element 142 can be pushed out of the valve chamber 136. The unique capsule shape of the valve element 142 prevents the valve element 142 from being unintentionally forced back into the valve chamber 136. This is useful in flowback operations in which the direction of flow is alternated within the wellbore 202.

In the embodiments depicted in FIGS. 4B, SB and 6B, the valve element 142 is captured in the first state by one or more shear pins 152 that extend through shear pin bore 154 extending through the housing 134. The shear pins 152 are designed to fail in response to the application of a force differential across the valve element 142 that exceeds a predetermined maximum shear load on the shear pins 152. The force generated by suction below the valve element 142 created by the acceleration of fluid through the bypass ports 140, combined with pressure acting on the outer face 146, is focused through the shear pins 152. Once the shear pins 152 fail, the valve element 142 is pulled down into the second state against the valve seat 138 to prevent further fluid flow through the plug 104. The use of shear pins 152 may be preferred over the frangible matrix 150 in applications in which the plug is made from materials that cannot be easily printed using additive manufacturing processes. In some embodiments, it may be desirable to make use of a combination of the frangible matrix 150 and the shear pins 152.

Figure 9:
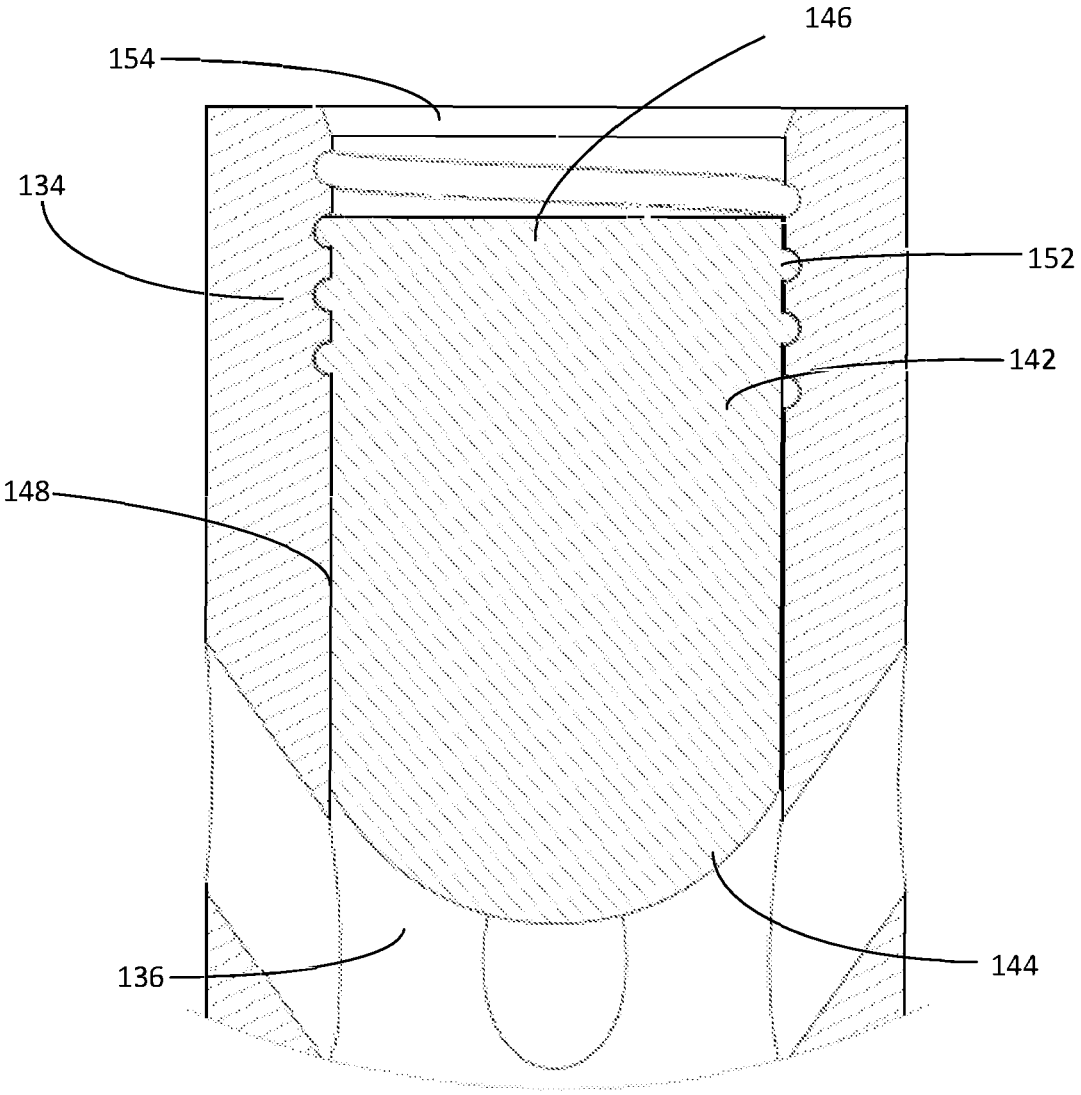
FIG. 9 is a close-up cross-sectional view of the valve element and shearable threads.

Turning to FIG. 9, shown therein is a third embodiment of the valve assembly 126, in which the valve element 142 is retained within the housing 134 by shearable threads 152 on the valve element 142 that are configured for a mating connection with corresponding shearable threads 154 located on the housing 134. The shearable threads 152, 154 are designed to fail under a design shearing load, which can be produced by a suction force generated by the acceleration of fluid through the bypass ports 140, and pressure applied to the outer face 146. When the shearable threads 152, 154 fail, the valve element 142 is pulled down into the valve seat 138, as described above. The shearable threads 152, 154 may be formed as unitary, integrated components within the housing 134 and valve element 142 during manufacture.

The plug 104 may also be constructed of a dissolvable material which will dissolve from the well bore 202 over time in the presence of well bore or other fluids, or of a drillable composite material which is impervious to wellbore fluids. Dissolvable materials may include magnesium, aluminum dissolvable alloys, and other dissolvable materials which are able to withstand the well conditions and specific job performance requirements.

Turning back to FIG. 2, three plugs 104 have been installed in the well bore 202. The two plugs 104 set deeper into the horizontal well bore 202 have been activated and are isolating the fractured sections of the formation 200. The third plug 104 located highest in horizontal well bore 200 has not been activated. This third plug 104 allows fluid to flow through the plug 104 in either direction. The perforation guns 102 have perforated a new section of the formation 200 and the plug 104 can be activated to isolate the new section for subsequent hydraulic fracturing. If, however, the perforation guns 102 misfired in the new section, the wireline 108 could be easily and quickly retracted and then deployed again with reloaded perforation guns 102. This is possible because the uphole plug 104 has not yet been activated (i.e., the valve element 142 is still retained in the first state by the frangible matrix 150 or the shear pins 152) and fluid can pumped through the plug 104 to assist in movement of the perforation gun 102 into the well bore 202.

It will be noted that although the plug and perforation system 100 is depicted in a horizontal deployment in FIGS. 1 and 2, the plug and perforation system 100 can also be used other applications, including in vertical and other non-horizontal wellbores 202. Accordingly, any references to "upper" or "higher" and "lower" or "deeper" within this disclosure are merely used to describe the relative positions of components within the plug and perforation system 100 and should not be construed as an indication that the plug and perforation system 100 must be deployed in a single orientation.

In this manner, a novel plug 104 and the incorporation of this novel plug 104 into plug and perforation systems 100 produces the various novel methods and apparatuses disclosed herein for controlling the flow of fluid through a plug 104 to provide a more versatile and efficient solution for isolating fracking zones and allowing fluid flow from a wellbore 202. It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

The invention claimed is:

1. A plug configured to isolate formation zones within a wellbore that has a casing, the plug comprising:

an anchoring subassembly configured to secure the plug in the casing of the wellbore;

a sealing device configured to prevent flow around the plug within the casing of the wellbore; and a flow control subassembly configured to control the flow of fluid through the plug, the flow control subassembly comprising:

a mandrel having a central, longitudinal axis and defining a central flow passage; and a valve assembly coupled to the mandrel, the valve assembly comprising:

a housing;

a valve chamber inside the housing;

a valve seat between the valve chamber and the central flow passage of the mandrel;

a valve element inside the valve chamber, wherein the valve element is secured to the housing with a frangible matrix when the valve element is in a first position and spaced apart from the valve seat;

a plurality of bypass ports in fluid communication with the valve chamber, each of the plurality of bypass ports angled inward toward the valve seat and having a central axis that is not perpendicular to the central, longitudinal axis of the mandrel;

where the valve element is configured to shift from (a) the first position in which the plurality of bypass ports are in fluid communication, through the valve chamber, with the central flow passage of the mandrel, to (b) a second position in which the valve element contacts the valve seat to prevent fluid communication between the plurality of the bypass ports and the central flow passage of the mandrel.

2. The plug of claim 1, where the anchoring subassembly includes an upper slip assembly and a lower slip assembly, the lower slip assembly comprising a plurality of individual slips and a tapered expansion element, the tapered expansion element comprising a plurality of distinct outer surface segments with each outer surface interacting with only a corresponding one of the plurality of individual slips.

3. The plug of claim 2, where the tapered expansion element comprises a plurality of radially protruding portions between adjacent ones of the distinct outer surface segments, each of the radially protruding portion is configured to extend between adjacent ones of the plurality of individual slips.

4. The plug of claim 1, where the anchoring subassembly includes an upper slip assembly and a lower slip assembly, the lower slip assembly comprising a plurality of individual slips and a tapered expansion element, the tapered expansion element comprising a plurality of radially protruding portions each configured to extend between adjacent ones of the plurality of individual slips.

5. The plug of claim 1, where the valve element includes a flat outer face and a rounded sealing surface shaped to contact a sealing surface the valve seat.

6. The plug of claim 1, where the frangible matrix is configured to fail when a force differential across the valve element exceeds a predetermined maximum shear load on the frangible matrix.

7. The plug of claim 1, where the frangible matrix, housing and valve element are constructed as a unitary piece.

8. The plug of claim 7, where the frangible matrix, housing and valve element comprise polymer and are optionally formed through an additive manufacturing process.

9. The plug of claim 1, where the valve element is configured to be flowed back out of the valve chamber, and is shaped to thereafter resist reentering the valve chamber.

10. A plug configured to isolate formation zones within a wellbore that has a casing, the plug comprising:

an anchoring subassembly configured to secure the plug in the casing of the wellbore, where the anchoring subassembly includes an upper slip assembly and a lower slip assembly, the lower slip assembly comprising a plurality of individual slips and a tapered expansion element, the tapered expansion element having a circumferentially continuous portion comprising a plurality of distinct outer surface segments with each outer surface interacting with only a corresponding one of the plurality of individual slips; and a sealing device configured to prevent flow around the plug within the casing of the wellbore, where the sealing device is located between the upper slips and the lower slips; and a flow control subassembly configured to control the flow of fluid through the plug, the flow control subassembly comprising:

a mandrel having a central, longitudinal axis and defining a central flow passage; and a valve assembly coupled to the mandrel, wherein the valve assembly comprises:

a housing;

a valve chamber inside the housing;

a valve seat between the valve chamber and the central flow passage of the mandrel; and a valve element inside the valve chamber, wherein the valve element is secured to the housing with one or more shear pins or shearable threads when the valve element is in a first position and spaced apart from the valve seat;

a plurality of bypass ports in fluid communication with the valve chamber, each of the plurality of bypass ports angled inward toward the valve seat and having a central axis that is not perpendicular to the central, longitudinal axis of the mandrel;

where the valve element is configured to shift from (a) the first position in which the plurality of bypass ports are in fluid communication, through the valve chamber, with the central flow passage of the mandrel, to (b) a second position in which the valve element contacts the valve seat to prevent fluid communication between the plurality of the bypass ports and the central flow passage of the mandrel.

11. The plug of claim 10, where the tapered expansion element comprises a plurality of radially protruding portions between adjacent ones of the distinct outer surface segments, each of the radially protruding portion is configured to extend between adjacent ones of the plurality of individual slips.

12. The plug of claim 10, where the tapered expansion element comprises a plurality of radially protruding portions between adjacent ones of the distinct outer surface segments, each of the radially protruding portion is configured to extend between adjacent ones of the plurality of individual slips.

13. The plug of claim 10, where the valve element includes a flat outer face and a rounded sealing surface shaped to contact a sealing surface the valve seat.

14. The plug of claim 10, where the one or more shear pins or shearable threads are configured to fail when a force differential across the valve element exceeds a predetermined maximum shear load on the one or more shear pins.

15. The plug of claim 10, where the valve element is secured to the housing by a plurality of shear pins that extend through shear pin bores defined in the housing.

16. The plug of claim 10, where the valve element is configured to be flowed back out of the valve chamber, and is shaped to thereafter resist reentering the valve chamber.

17. A plug configured to isolate formation zones within a wellbore that has a casing, the plug comprising:

an anchoring subassembly configured to secure the plug in the casing of the wellbore, where the anchoring subassembly includes an upper slip assembly and a lower slip assembly, the lower slip assembly comprising a plurality of individual slips and a tapered expansion element, the tapered expansion element having a circumferentially continuous portion comprising a plurality of radially protruding portions each configured to extend between adjacent ones of the plurality of individual slips; and a sealing device configured to prevent flow around the plug within the casing of the wellbore, where the sealing device is located between the upper slips and the lower slips; and a flow control subassembly configured to control the flow of fluid through the plug, the flow control subassembly comprising:

a mandrel having a central, longitudinal axis and that includes a central flow passage; and a valve assembly, wherein the valve assembly comprises:

a housing;

a valve chamber inside the housing;

a valve seat between the valve chamber and the central flow passage of the mandrel; and a valve element inside the valve chamber, wherein the valve element is secured to the housing with corresponding shearable pins or threads when the valve element is in a first position and spaced apart from the valve seat;

a plurality of bypass ports in fluid communication with the valve chamber, each of the plurality of bypass ports angled inward toward the valve seat and having a central axis that is not perpendicular to the central, longitudinal axis of the mandrel;

where the valve element is configured to shift from (a) the first position in which the plurality of bypass ports are in fluid communication, through the valve chamber, with the central flow passage of the mandrel, to (b) a second position in which the valve element contacts the valve seat to prevent fluid communication between the plurality of the bypass ports and the central flow passage of the mandrel.

18. The plug of claim 17, where the one or more shear pins or shearable threads are configured to fail when a force differential across the valve element exceeds a predetermined maximum shear load on the one or more shear pins.

19. The plug of claim 17, where the shearable threads, housing and valve element are constructed as a unitary piece from a polymer through an additive manufacturing process.

20. The plug of claim 17, where the valve element is configured to be flowed back out of the valve chamber, and is shaped to thereafter resist reentering the valve chamber.

* * * * *